United States Patent [19]

Burman

[11] 3,931,839

[45] Jan. 13, 1976

[54] MULTIPLE BIT WIRE WRAP TOOL

[75] Inventor: Per Aron Burman, Temple City, Calif.

[73] Assignee: Burroughs Corporation, Detroit, Mich.

[22] Filed: Mar. 4, 1975

[21] Appl. No.: 555,237

[52] U.S. Cl. ..... 140/124; 242/7.17

[51] Int. Cl.[2] ..... B21F 3/00; B65H 81/06

[58] Field of Search ..... 29/33 F, 203 D, 203 DT, 29/203 H, 203 HM; 140/115, 122, 124; 242/7.06, 7.17, 7.18

[56] References Cited

UNITED STATES PATENTS

| | | | |
|---|---|---|---|
| 3,443,606 | 5/1969 | Atkinson | 242/7.17 |
| 3,675,861 | 7/1972 | Baker et al. | 242/7.17 |
| 3,717,183 | 2/1973 | Coss | 140/124 |
| R26,791 | 2/1970 | Etchison et al. | 140/124 |

FOREIGN PATENTS OR APPLICATIONS

| | | | |
|---|---|---|---|
| 194,817 | 3/1965 | Sweden | 140/124 |

*Primary Examiner*—C. W. Lanham
*Assistant Examiner*—E. M. Combs
*Attorney, Agent, or Firm*—William B. Penn; Nathan Cass; Kevin R. Peterson

[57] ABSTRACT

A multiple bit wire wrap tool for simultaneously connecting a plurality of conductors to adjacent closely spaced electrical terminal pins by spirally wrapping the conductors around the terminal pins. The tool has a circumferentially rotatable swivel block connected to a motor driven eccentric shaft for circumferential rotation therewith. The multiple bits have eccentric portions mounted in the swivel block for producing axial rotation of the bits.

19 Claims, 8 Drawing Figures

MULTIPLE BIT WIRE WRAP TOOL

BACKGROUND OF THE INVENTION

The extensive use of coaxial wire in contemporary computer systems has provided the need to develop an inexpensive wire wrap tool capable of accurately wrapping the conductors of coaxial wire around adjacent terminals in the back plane panels commonly employed in computers. System reliability and production efficiency require that each wrap comrpises a proper connection of conductor and terminal. Prior art devices are known that simultaneously wrap multiple conductors around adjacent terminals. These devices have been found to be cumbersome, inefficient, and unsuitable for use with terminals as closely spaced as those in back plane panels.

The prior art devices, as exemplified in U.S. Pat. No. 3,443,606, primarily employ drive shafts rotatably driven by electric or air motors which are interconnected to wrapping bits by means of gear assemblies. The bits of a multiple bit wire wrap tool must be closely spaced because of the close proximity of the terminal pins in the back plane panels employed in present day computers. The closer tolerances require that the gears employed in the gear assemblies of these tools must be of small dimensions. Inherent with the use of these small gears are several disadvantages which make prior art devices unsuitable for use with present day back plane panels. One disadvantage of prior art devices is that gears of small dimension and precise construction are expensive to manufacture and their inclusion in the wire wrap tool inflates the cost. Another disadvantage is that intermeshing the small gears with the rotatable driveshaft results in the wrapping bits being driven at an excessively high rpm, thereby increasing the possibility of broken conductors, cracked insulation and improper wraps resulting from overlapping the turns of the conductors.

The circumferentially rotatable swivel block employed in the present invention obviates the need for gear assemblies and achieves a one to one ratio between rotation of an eccentric driveshaft and rotation of the wrapping bits. This ratio is not obtainable with the gear assemblies of prior art devices.

Another feature of this invention is that upon completion of each wrap the bits are returned to a precise predetermined home position. This feature is important because uniform wraps of multiple conductors around adjacent terminals are obtainable only when the conductor receiving bores in the wrapping ends of the bits are adjacently aligned at the completion of the previous wrap. Prior art devices are not capable of automatically orienting the bits in precise home positions after each wrap because of the high frictional resistances inherent within their gear assemblies.

The present invention is designed to overcome the disadvantages of the prior art devices by providing novel features which accomplish desired advantages.

It is therefore an object of this invention to provide a simple and low cost multiple bit wire wrap tool capable of simultaneously wrapping the conductors of coaxial wire around adjacent terminals.

It is a further object of this invention to provide a multiple bit wire wrap tool wherein the need for gear assemblies is eliminated by providing a simple and efficient drive system to transfer rotation of a drive motor into rotation of wrapping bits. This drive system comprises an eccentric drive shaft cooperating with a circumferentially rotatable swivel block to achieve axial rotation of eccentric wrapping bits received thereon.

Another object of this invention is to provide a multiple wire wrap tool whereby the wrapping bits are returned to a home position upon completion of each wrap.

Still another object of this invention is to provide a multiple bit wire wrap tool whereby high production rates are achieved by reducing the possibility of damage to the conductors during the wrapping process.

It is yet another object of this invention to provide a multiple bit wire wrap tool with which precise and reliable connections will be imparted between the conductors and terminals.

SUMMARY OF THE INVENTION

The mulitple bit wire wrap tool of the present invention achieves these and other objects by providing a circumferentially rotatable swivel block in cooperation with a rotatable drive means and multiple wrapping bits. Circumferential rotation of the swiveling block is achieved by an eccentric driveshaft properly connected to and rotatably driven by a motor. Closely spaced, parallel spindles extend linearly from the swivel block and have eccentric portions received in apertures thereon. Rotation of the spindles is achieved through the cooperation of the eccentric portions of the spindles and the circumferentially rotatable swivel lock. The spindles extend coaxially through cylindrical wrapping sleeves and have two axial bores at their distal ends. One bore in each spindle receives a terminal pin and the other bore receives a conductor.

In accordance with a preferred embodiment the multiple bit wire wrap tool is hand held, requiring the operator to feed the conductors into their appropriate openings, position the bits around the proper terminals, and impart the wraps to the terminals by activating the drive motor while simultaneously drawing the bits axially along the terminal pins. A further embodiment of the invention includes a semi-automatic multiple bit wire wrap tool wherein the wrapping sleeves are retractable with respect to the bit spindles to allow easy insertion of the conductors into respective conductor receiving slots.

BRIEF DESCRIPTION OF THE DRAWING

The foregoing objects, features and advantages of the invention, along with other objects and advantages which may be obtained by its use, will be apparent from the following detailed description when read in conjunction with the accompanying drawing wherein.

DETAILED DESCRIPTION OF THE PREFERRED EMBODIMENT

Figure 1:
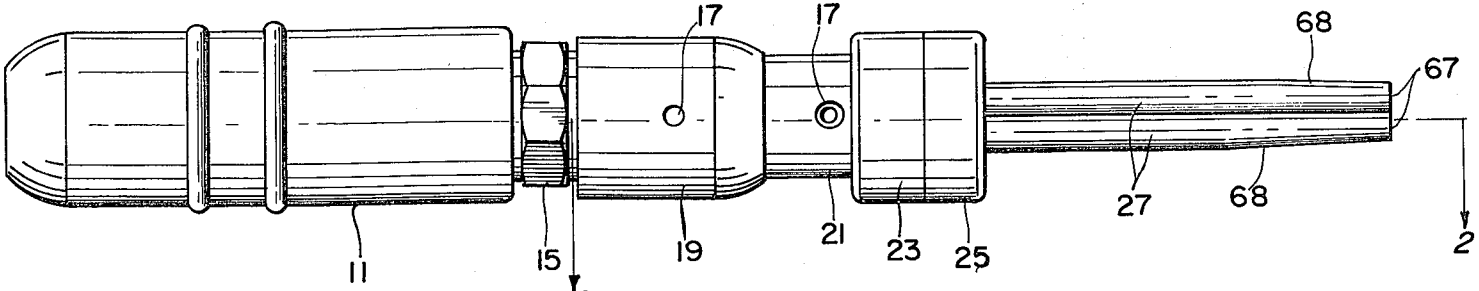
FIG. 1 is a top view of a preferred embodiment showing a hand held tool and the outer structural elements.

Referring more particularly to the drawings, the tool includes a body 11 within which there is a rotary air or electric motor controllable by trigger 13 in the usual manner. Locking nut 15 secures drive housing 31 to the tool body 11. The bit assembly generally comprises cylindrical connecting sleeve 21, back plate 23, face plate 25 and wrapping sleeves 27. The assembly is securely fastened to shaft housing 31 by tightening clamping nut 19 onto the threaded portion 29 of shaft housing 31. The inner lip of the clamping nut 19 which abuts the shoulder of the connecting sleeve 21 secures the connecting sleeve 21 against the shaft housing 31. Appropriate set screws generally indicated as 17 are provided to prevent vibrational forces from loosening the clamping nut 19 or the connecting sleeve 21.

Figure 2:
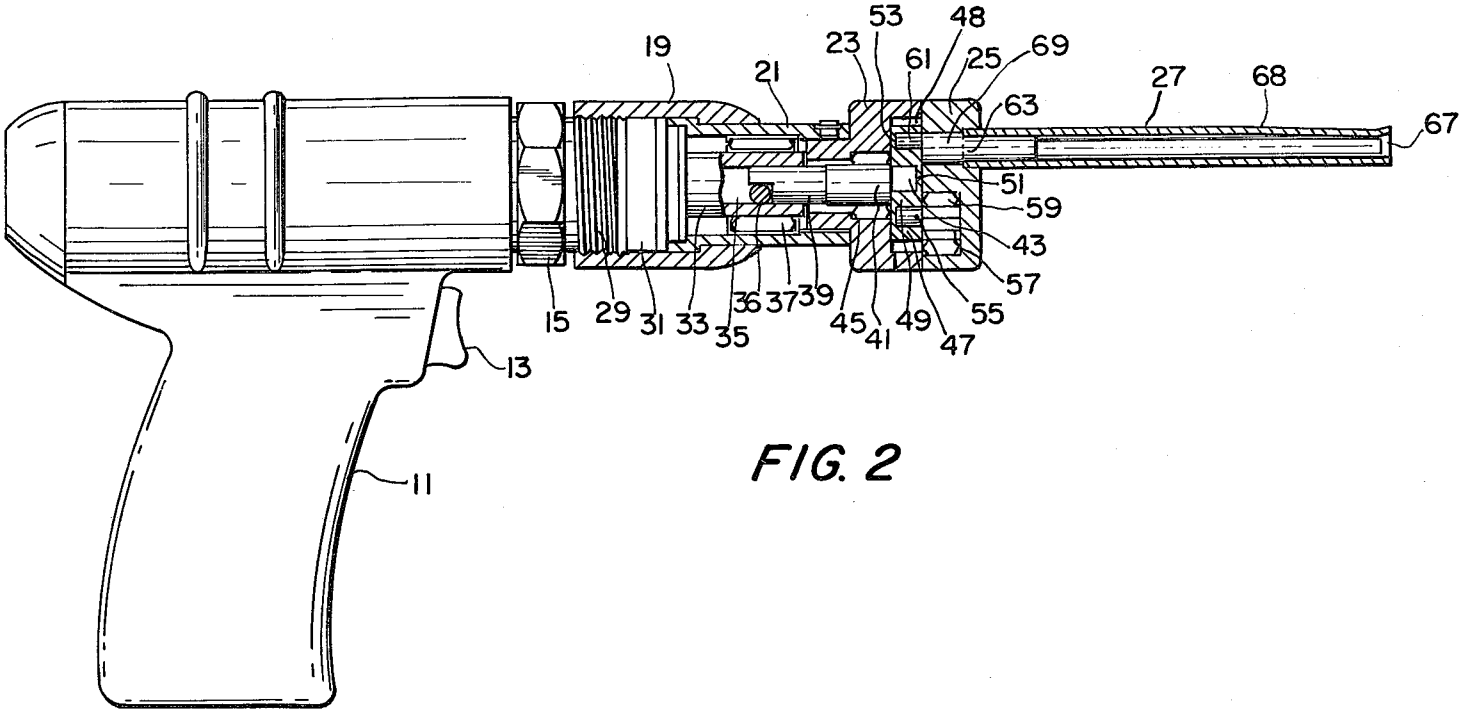
FIG. 2 is a view of portion of the tool shown in FIG. 1 and shows a cross sectional side view of the bit driving mechanism taken along the line 2—2 in FIG. 1.

As shown in FIG. 2, a drive sleeve 33 extends from the body of the tool 11. The connection of the drive sleeve 33 to the rotary motor by means of a clutch assembly is not shown. The indexing clutch assembly utilized is of a type well-known in the art. Depressing the trigger 13 actuates the rotary motor and engages the clutch assembly causing the drive sleeve 33 to rotate. When trigger 13 is released the clutch is disengaged from the drive sleeve 33 in such a manner as to arrest the rotating drive sleeve 33 in a predetermined rotary position. A representative clutch indexing mechanism suitable for use in this invention is disclosed in U.S. Pat. No. 3,464,527 issued to William J. Baker on Sept. 2, 1969, entitled *Clutch and Indexing Mechanism for Tool Spindle*, which patent is hereby incorporated by reference in this disclosure.

Figure 6:
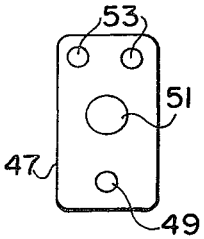
FIG. 6 shows a frontal view of the swivel block employed in the drive assembly of the tool.

Referring again to FIG. 2, rotatable drive sleeve 33 extends through shaft housing 31 and coaxially surrounds rotatable drive spindle 35. A needle bearing 37 journals rotatable drive sleeve 33. Notched end 36 of the drive spindle 35 engages a similarly notched end 39 of rotatable drive shaft 41 resulting in rotation of drive shaft 41 upon rotation of drive spindle 35. An eccentric portion 43 of the drive shaft 41 rotates upon rotation of the drive shaft 41. The rotation of the eccentric portion 43 is about the axis of drive shaft 41 with the radius of the rotation dependent upon how offset the eccentric portion 43 is from the axis of drive shaft 41. A swivel block 47, in this case a planar member having opposite sides or any other suitable rigid member, is disposed for planar movement within a chamber 48 formed by back plate 23 and face plate 25. FIG. 6 shows a frontal view of this swivel block 47. An aperture 51 centrally formed in the swivel block 47 and extending to one surface of the swivel block 47 receives the eccentric portion 43 of the rotatable drive shaft 41. This aperture 51 has a diameter which is somewhat larger than the diameter of the eccentric portion 43 of the rotatable drive shaft 41 to allow the eccentric portion 43 to rotate within the aperture 51 while remaining contiguous with the side of the aperture 51. The rotation of the eccentric portion 43 produces displacement of the swivel block 47 in planar directions that describes rotation about the axis of drive shaft 41, while the swivel block 47 maintains a predetermined, constant spatial orientation within the chamber 48. This may be considered circumferential rotation of the entire swivel block 47 about the axis of drive shaft 41 with a radius of rotation equal to the offset distance of eccentric portion 43. This requires that the chamber 48 be of sufficient size to permit the swivel block 47 to be displaced in any X—Y direction within the chamber 48 a distance equal to the offset distance of eccentric portion 43 of drive shaft 41.

An aperture 49 formed in the lower portion of the swivel block 47 securely receives the eccentric portion 55 of rotatable stabilizer 57 for rotation therein. The eccentric portion 55 of the stabilizer 57 follows the aperture 49 as it rotates about the axis of the stabilizer 57. The stabilizer 57 restrains the swivel block 47 from tilting out of its plane of displacement. The eccentric portion 55 must be offset on the stabilizer 57 a distance equal to the offset of eccentric portion 43 on drive shaft 41 since both eccentric portions 43 and 55 are interacting with the swivel block 47. This factor also requires that the eccentric portions 43 and 55 rotate in phase with each other. Stabilizer 57 rotates in bearing 59.

A plurality of apertures 53 are formed in the upper portion of swivel block 47 and extend to the surface of the swivel block 47 opposite the one to which the central aperture 51 extends. Each of the apertures 53 receives an eccentric portion 61 of respective rotatable wrapping bit spindles 63 for axial rotation therein. The eccentric portion 61 travel with their respective apertures 53 as the apertures 53 are displaced upon circumferential rotation of the swivel block 47. These movements of the eccentric portions 61 are circumferential about the axis of their respective spindles 63. The eccentric portions 61 are offset on the spindles 63 to the same extent as the eccentric portion 43 is offset on the drive shaft 41 because the eccentric portions 61 of the spindles 63 and the eccentric portion 43 of the drive shaft 43 are all received in respective apertures formed on the circumferentially rotatable swivel block 47. The eccentric portion 43 of the drive shaft 41 is mounted in the swivel block 47 to produce a circumferential revolution of the swivel block 47 upon every axial revolution of the drive shaft 41. The eccentric portions 61 of the spindles 63 are mounted in the swivel block 47 such that every circumferential revolution of the swivel block 47 produces an axial revolution of each spindle 63.

To delineate further the operation of the drive system it will be clear that the drive shaft 41 is adapted for axial rotation. The rotation is translated by the eccentric portion 43 of drive shaft 41 into rotation about the axis of the driveshaft 41. The swivel block 47 is cooperable with the eccentric portion 43 of the rotatable drive shaft 41 to translate the rotation of the eccentric portion 43 of drive shaft 41 into circumferential rotation of the swivel block 47. The swivel block 47 functions as a member wherein a plurality of elements can be mounted for circumferential rotation. These elements are the eccentric portions 61 of respective spindles 63. The eccentric portions 61 of the spindles 63 translate the circumferential rotation of the swivel block 47 into axial rotation of the spindles 63.

The spindles 63 extend closely spaced and in parallel from swivel block 47 and are coaxially surrounded by respective fixed wrapping sleeves 27. The spindles 63 terminate in bit faces 67. Bores 69 and 71 extend axially within the spindles 63 from the bit faces 67.

Figure 7:
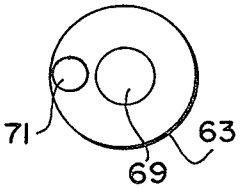
FIG. 7 shows a frontal view of a wrapping bit face.

FIG. 7 provides a frontal view of a bit face 67, and its respective bores 69 and 71. Bore 69 is centrally located on the bit face 67 and is of appropriate size to permit axial insertion of a terminal pin therein. A bore 71 is peripherally located on the bit face 67 and is adapted to receive the end of a conductor wire to be wrapped around the terminal pin received by central bore 69.

If the appropriate conductor wires and terminal pins have been inserted in their respective bores 69 and 71, the conductor wires will be wrapped around the terminal pins upon triggering the rotary motor in the tool body 11. The desired spiral wraps are imparted when the operator manipulates the tool so that the bits 68 are axially drawn along the terminal pins simultaneously with rotation of the bits 68.

Employing the clutch indexing mechanism in cooperation with the relatively friction free swivel block drive mechanism ensures the alignment of the conductor receiving bores 71 in predetermined home positions after each wrap. This facilitates the following insertion of conductors into the conductor receiving bores 71 of the spindles 63 and thus results in precise and uniform wraps.

Figure 3:
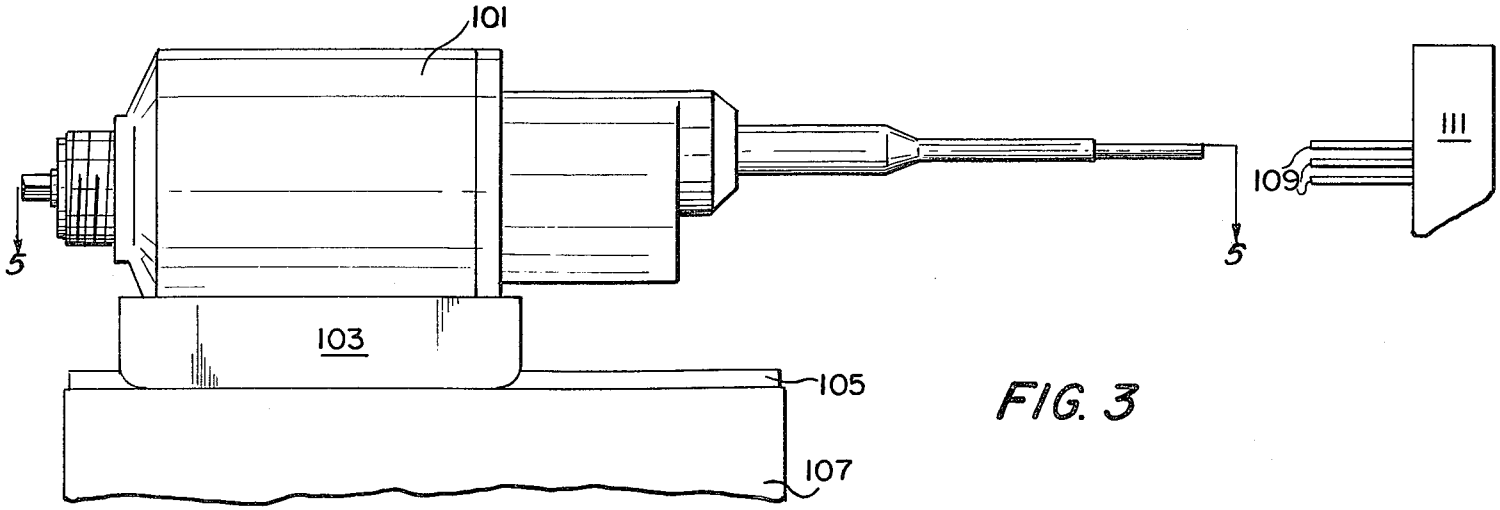
FIG. 3 is a side view of a second embodiment of the wire wrap tool showing the tool mounted on a carriage and pedestal assembly in relation to a back plane panel.

A second embodiment of this invention is shown in FIG. 3 in a semi-automatic wire wrapping system wherein the wire wrap tool 101 is adapted to be mounted on a carriage 103. The carriage 103 is displaceable along rails 105 mounted on fixed pedestal 107. The movement of the carriage 103 is constrained to be toward or away from terminal pins 109 extending perpendicularly from back plane panel 111. The carriage and pedestal assembly is not to be considered part of the present invention.

Figure 4:
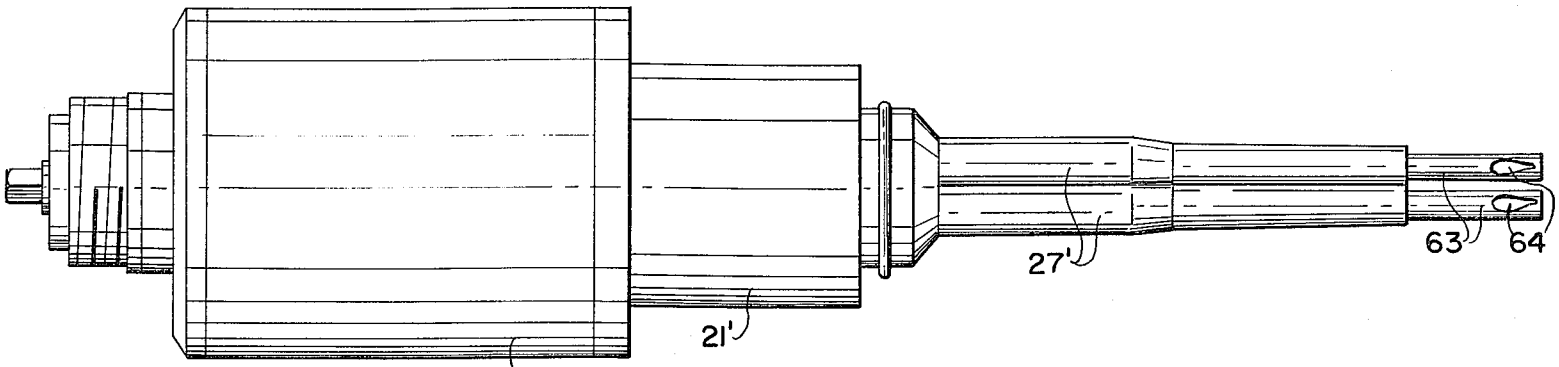
FIG. 4 is a top view showing the outer structural elements of the embodiment in FIG. 3.

The wire wrap tool itself as it appears in FIG. 4 includes an outer tool housing 75, connecting sleeve 21', wrapping sleeves 27', rotatable spindles 63 and conductor receiving slots 64.

Figure 5:
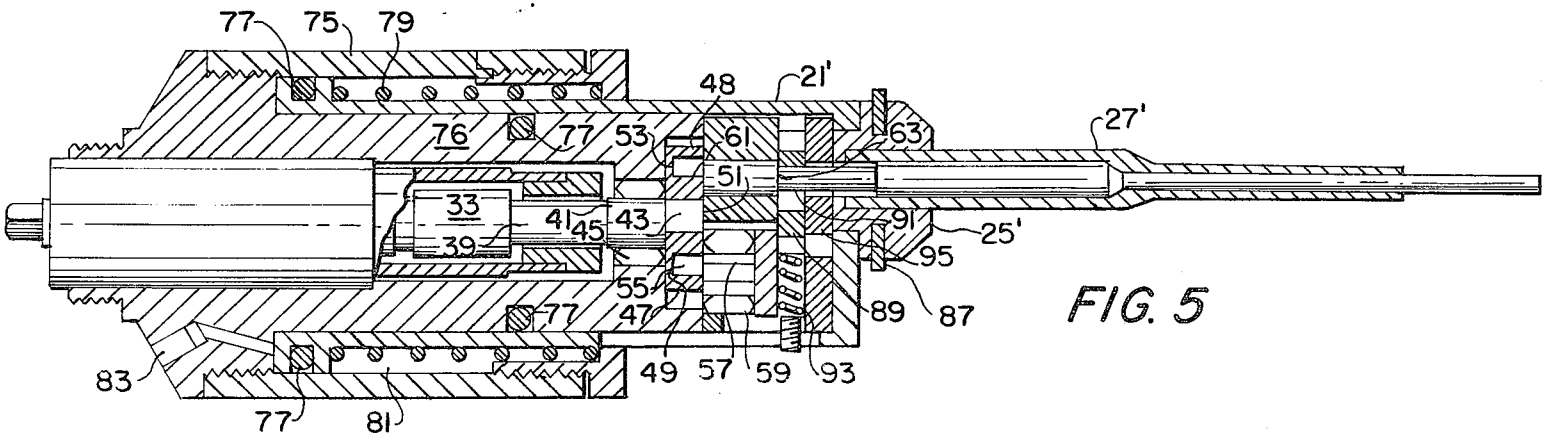
FIG. 5 is a cross sectional side view of the embodiment shown in FIG. 3, taken along the line 5—5.

Referring to FIG. 5 wherein parts of this embodiment are shown with greater particularity it will be understood that the components utilized to attain rotation of the spindles 63 are similar to those employed in the preferred embodiment with the following differences.

The wrapping sleeves 27' are retractable with respect to the spindles 63. The wrapping sleeves 27' together with the face plate 25' and connecting sleeve 21' comprise a retractable assembly which is mounted on bearings generally indicated as 77 for linear extension with respect to outer tool housing 75, inner tool housing 76 and spindles 63. This linear extension is accomplished by introducing air under pressure into expandable air chamber 81 through inlet 83. The pressure in the chamber 81 opposes the resiliency of retracting spring 79 to displace the retractable assembly in the direction of the distal ends of spindles 63. The retractable assembly returns to its normal retracted position when the air supply entering expandable chamber 81 is cut off and air is permitted to escape from the chamber 81 through inlet 83. The resultant reduction of pressure in chamber 83 permits extension of retracting spring 79 thereby displacing connecting sleeve 21', face plate 25' and wrapping sleeve 27' to their retracted positions. The control of air flow through air inlet 83 may be accomplished through the utilization of any appropriate switch and valve assembly. This assembly is not part of the subject invention. The switch may be actuated by means known in the art which are responsive to displacement of the carriage 103.

When the wrapping sleeves 27' are in their retracted position, conductor receiving slots 64 are exposed proximate the wrapping ends of spindles 63. The slots 64 are axially disposed along the surface of spindles 63 and are adapted for insertion therein of a conductor prior to each wrap. The sleeves 27' are extendable to cover the slots 64 and secure the conductors therein. The slots 64 are adjacently aligned in home positions after each wrap by means of the complete revolution clutch and swivel block assembly previously explained.

Figure 8:
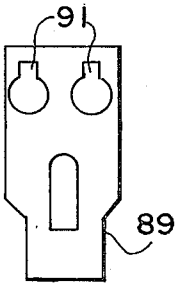
FIG. 8 displays a frontal view of the bit spindle locking plate of the FIG. 3 embodiment.

In the second embodiment the spindles 63 are easily removed from the wrapping tool to allow access to a damaged part or broken conductor. Vertical locking plate 89 as also shown in a frontal view in FIG. 8 has keyhole shaped apertures 91 formed thereon through which the spindles 63 extend. Biasing spring 93 resiliently positions the locking plate 89 such that the reduced diameter portions of the keyhole apertures 91 journal the spindles 63. To remove the spindles 63 from the tool, sleeve release 87 is depressed to permit wrappping sleeves 27' to be removed from the tool. Locking plate 89 must be vertically displaced against biasing spring 93 so that the enlarged diameter portions of keyhole apertures 91 journal the spindles 63. The spindles 63 are then removable from the tool.

It will be understood that the above description and accompanying drawings comprehend only a preferred and an alternate embodiment of the present invention and that various changes and alterations may be made by those skilled in the art without departing from the scope and spirit of the invention as set forth in the appended claims.

What is claimed is:

1. In a multiple bit wire wrap tool:
an axially rotatable driveshaft;
a swivel block having opposite planar surfaces;
an eccentric means connecting said driveshaft to one planar surface of said swivel block for circumferentially rotating said swivel block about the axis of said rotatable driveshaft and for maintaining said swivel block in a predetermined, constant spatial orientation;
a plurality of eccentric members each connected at one end to the opposite planar surface of said swivel block for rotation of each of said one ends about the respective axis of each of said eccentric members upon circumferential rotation of said swivel block thereby effecting axial rotation of respective other ends of said eccentric members;
said respective other ends being adapted to receive respective ones of a plurality of wire wrapping bits for eccentric rotation therewith.

2. The multiple bit wire wrap tool of claim 1 wherein said eccentric means comprises an eccentric portion formed on and extending axially from the end of said axially rotatable driveshaft.

3. The multiple bit wire wrap tool of claim 2 wherein said swivel block comprises:
a rigid member adapted for planar displacement;
an aperture centrally formed in said rigid member and extending to one planar surface thereof, said aperture adapted to receive therein said eccentric portion for rotation contiguous with the side of said aperture to thereby circumferentially rotate said swivel block about the axis of said rotatable driveshaft and to maintain said swivel block in a predetermined, constant spatial orientation;
a plurality of apertures peripherally formed in said swivel block and extending to the opposite planar surface thereof.

4. The multiple bit wire wrap tool of claim 3 wherein said eccentric members comprise rotatable shafts having an eccentric portion formed at each of said one ends, said eccentric portions adapted for insertion into respective ones of said plurality of apertures peripherally formed on said swivel block.

5. The multiple bit wire wrap tool of claim 4 further including a plurality of wire-wrap bits wherein each of said wire wrap bits comprise:

a rotatable elongated member having respective proximate and distal ends, said proximate end being integrally formed on a respective other end of one of said plurality of eccentric members and extending axially therefrom;

a first bore centrally formed in said elongated member and extending axially from said distal end, said first bore adapted to coaxially receive a conductor inserted therein;

a second bore peripherally formed in said elongated member and extending axially from said distal end, said second bore adapted to coaxially receive a conductor inserted therein;

a non-rotatable sleeve coaxially surrounding said elongated member.

6. The multiple bit wire wrap tool of claim 5 wherein said plurality of second bores are aligned in predetermined home positions upon termination of each wrap.

7. The multiple bit wire wrap tool of claim 6 wherein said plurality of second bores extend axially along the surfaces of respective ones of said plurality of elongated members to form conductor receiving slots thereon.

8. The multiple bit wire wrap tool of claim 7 wherein said plurality of non-rotatable sleeves coaxially surrounding said plurality of elongated members are axially displaceable along said plurality of elongated members to thereby cover or expose said plurality of conductor receiving slots.

9. The wire wrap tool of claim 8 wherein said plurality of wire wrap bits are removeable from said multiple bit wire wrap tool.

10. In a multiple bit wire wrap tool:

an axially rotatable driveshaft;

an eccentric portion formed at one end of said driveshaft;

a swivel block having opposite planar surfaces;

an aperture centrally formed in said swivel block and extending to one planar surface thereof, said aperture adapted to receive therein said eccentric portion for rotation thereof contiguous with the side of said aperture to thereby circumferentially rotate said swivel block about the axis of said driveshaft while maintaininng said swivel block in a predetermined, constant spatial orientation;

a plurality of apertures peripherally formed in said swivel block and extending to the opposite planar surface thereof, said plurality of apertures adapted to receive respective ends of a plurality of wire wrap bits.

11. The wire wrap tool of claim 10 further including a plurality of wire wrap bits wherein each of said wire wrap bits comprises:

an elongated member having respective proximate and distal ends;

an eccentric portion formed on said proximate end, said eccentric portion adapted for insertion into a respective one of said plurality of apertures peripherally formed on said swivel block;

a first bore centrally formed in said elongated member and extending axially frm said distal end, said first bore adapted to coaxially receive a terminal pin inserted therein;

a second bore peripherally formed in said elongated member and extending axially from said distal end, said second bore adapted to receive a conductor wire inserted therein;

a non-rotatable sleeve coaxially surrounding said elongated member.

12. The multiple bit wire wrap tool of claim 11 wherein said plurality of second bores are aligned in predetermined home positions upon termination of each wrap.

13. The multiple bit wire wrap tool of claim 12 wherein said plurality of second bores extend axially along the surfaces of respective ones of said plurality of elongated members to form conductor receiving slots thereon.

14. The multiple bit wire wrap tool of claim 13 wherein said plurality of sleeves coaxially surrounding said plurality of elongated members are axially displaceable along said plurality of elongated members to thereby cover or expose said plurality of conductor receiving slots.

15. The multiple bit wire wrap tool of claim 14 wherein said plurality of wire wrap bits are removeable from said multiple bit wire wrap tool.

16. In a multiple bit wire wrap tool: a driveshaft adapted for axial rotation;

eccentric means on said driveshaft for rotation about the axis of said driveshaft;

planar means having opposite surfaces;

one surface of said planar means formed to cooperate with said eccentric means for circumferential rotation of said planar means about the axis of said rotatable driveshaft upon rotation of said driveshaft;

a plurality of eccentric translation means attached to the opposite surface of said planar means for translating said circumferential rotation of said planar means into axial rotation of said plurality of eccentric translation means;

said plurality of eccentric translation means being adapted to receive a plurality of wire wrap bits for axial rotation therewith.

17. The multiple bit wire wrap tool of claim 16 wherein said eccentric means comprises an eccentric portion integrally formed on one end of said driveshaft.

18. The multiple bit wire wrap tool of claim 17 wherein said planar means comprises:

a rigid member;

an aperture centrally formed in said rigid member and extending to one planar surface of said rigid member, said aperture adapted to receive therein said eccentric portion for rotation contiguous with the side of said aperture to thereby circumferentially rotate said rigid member about the axis of said rotatable driveshaft and to maintain said rigid member in a predetermined, constant spatial orientation;

a plurality of apertures peripherally formed in said rigid member and extending to the opposite planar surface of said rigid member.

19. The multiple bit wire wrap tool of claim 18 wherein said plurality of eccentric translation means comprise axially rotatable members each having an eccentric portion integrally formed at one end, said plurality of eccentric translation means being attached to said rigid member by insertion of said eccentric portions into respective ones of said plurality of apertures to thereby axially rotate respective other ends of said rotatable members upon circumferential rotation of said rigid member.

* * * * *